US008889204B1

(12) United States Patent
Conroy

(10) Patent No.: US 8,889,204 B1
(45) Date of Patent: Nov. 18, 2014

(54) FRUIT JUICE AND FRUIT SLICES CONTAINER

(76) Inventor: Matthew Conroy, Troy, NY (US)

( * ) Notice: Subject to any disclaimer, the term of this patent is extended or adjusted under 35 U.S.C. 154(b) by 279 days.

(21) Appl. No.: 13/524,818

(22) Filed: Jun. 15, 2012

Related U.S. Application Data

(60) Provisional application No. 61/498,212, filed on Jun. 17, 2011.

(51) Int. Cl.
*A47G 21/18* (2006.01)

(52) U.S. Cl.
USPC ..... 426/85; 426/106; 426/115; 426/119; 426/120; 426/122; 383/104

(58) Field of Classification Search
CPC ... A47G 21/181; A47G 21/183; A47G 21/18; B65D 2231/022; B65D 75/008; B65D 2231/02; B65D 2581/3429; B65D 2581/3432; B65D 77/28
USPC ..... 426/85, 106, 115, 119–120, 122, 104; D9/717; 206/586; 383/104
See application file for complete search history.

(56) References Cited

U.S. PATENT DOCUMENTS

| | | | | |
|---|---|---|---|---|
| 3,799,914 | A * | 3/1974 | Schmit | 426/85 |
| 4,072,233 | A * | 2/1978 | Kramer et al. | 383/202 |
| 5,758,473 | A * | 6/1998 | Patelli | 53/412 |
| 6,485,177 | B2 * | 11/2002 | Bell | 383/210 |
| 8,354,130 | B2 * | 1/2013 | Tseng | 426/115 |
| 8,535,744 | B1 * | 9/2013 | Taghaddos | 426/393 |
| 2007/0231431 | A1 * | 10/2007 | Roche et al. | 426/85 |
| 2008/0089983 | A1 * | 4/2008 | Coste | 426/106 |
| 2008/0308584 | A1 * | 12/2008 | Blondeel | 222/541.9 |
| 2010/0186237 | A1 * | 7/2010 | Cunningham | 30/123.3 |

FOREIGN PATENT DOCUMENTS

| | | | | |
|---|---|---|---|---|
| JP | 09234043 | A * | 9/1997 | A23L 2/42 |
| WO | WO 0106900 | A1 * | 2/2001 | A23G 3/00 |

* cited by examiner

*Primary Examiner* — Drew Becker
*Assistant Examiner* — Luana Z Long
(74) *Attorney, Agent, or Firm* — Heslin Rothenberg Farley & Mesiti P.C.

(57) ABSTRACT

The invention provides an apparatus to ease the consumption of drink and food including a sleeve of flexible material, a perforation formed in one end of the sleeve configured to be removed and form an opening in communication with a chamber formed in the sleeve. The apparatus also includes a straw with a first end to be inserted into the chamber through the sleeve, and a second end with at least one prong to be inserted into the chamber and the food. The second end may be inserted through the opening. The invention also provides a method of consuming food and drink from an apparatus. The invention further provides a method of assembling a snack apparatus.

11 Claims, 5 Drawing Sheets

FRUIT JUICE AND FRUIT SLICES CONTAINER

CLAIM OF PRIORITY

This application claims priority to U.S. Provisional Application No. 61/498,212 filed Jun. 17, 2011 and titled "Fruit Juice and Fruit Slices Container", which is incorporated herein by reference in its entirety.

TECHNICAL FIELD

This invention relates generally to the field of snack pouches.

BACKGROUND OF THE INVENTION

Increasingly, beverage providers, particularly fruit drink providers package drinks in flexible pouches. In particular, a single serving of juice or another drink is provided in a flexible pouch with a straw in a separate disposable wrapper that is releasably attached to the outside of the flexible pouch. The straw is most commonly provided with a sharpened end that can be used to puncture the flexible pouch, while the flexible pouch has a target puncture zone. A user detaches the straw and removes the straw from the wrapper, punctures the flexible pouch at the puncture zone using the sharpened end of the straw. The user may then drink the juice through the straw using a sucking action and may press on the sides of the flexible pouch to force the liquid out through the straw.

SUMMARY OF THE INVENTION

Fruit, particularly fresh fruit, but also freeze dried, sun dried, bake dried or other dried fruit, is an important element of a healthy and well balanced diet. The present invention provides an apparatus that can be used to incorporate fresh fruit into easily portable snacks. In addition, the snacks can be frozen to preserve and easily transport the fruit.

The invention provides, in one aspect, an apparatus to ease the consumption of drink and food, including a sleeve of flexible material having a top end and a bottom end, the sleeve defining a chamber and the chamber configured to contain drink and food. The sleeve may also have a perforation formed in the top end, with a portion of the sleeve configured to be removed by tearing along the perforation to form an opening in communication with the chamber. The apparatus may also include a straw including a first end and a second end, the first end configured to be inserted into the chamber through the sleeve of flexible material and allow consumption of the drink. The second end of the straw may include at least one prong, the at least one prong configured to be inserted into the chamber and into the food. The sleeve may be sealed at the top end and at the bottom end. In another embodiment, a seal may be formed on the top end and configured to releasably attach a first side of the sleeve to a second side of the sleeve. In another embodiment, the straw comprises at least two prongs. In still another embodiment, the straw comprises three prongs. In another embodiment, each of the at least two prongs functions as a straw. In another embodiment, the apparatus is configured to be frozen. In another embodiment, the food comprises fruit slices. In still another embodiment, the drink is pure fruit juice.

The invention provides, in another aspect, a method of consuming drink and food from an apparatus, including the step of providing an apparatus containing food and drink, where the apparatus includes a sleeve of flexible material and a straw. The sleeve of flexible material may have a sealed top end and a sealed bottom end, a chamber configured to contain food and drink and a perforation formed in the top end. The straw may include a first end configured to be inserted into the sleeve through the flexible material and a second end comprising at least one prong. The at least one prong of the straw may be configured to be inserted into the chamber and into the food. The method may also include the step of inserting the straw into the chamber through the flexible material. The step of drinking the drink through the straw may also be included, as well as the steps of removing the straw from the apparatus and tearing the perforation to create an opening in communication with the chamber. The method may also include the steps of inserting the second end of the straw into the chamber and into the food and removing the food from the chamber and eating the food. In another embodiment, the method may include the step of sealing the sleeve, where the sleeve includes a seal formed on the top end and the seal is configured to releasably attach a first side of the sleeve to a second side of the sleeve. In another embodiment, the method may also include freezing the apparatus and thawing the apparatus.

According to another aspect of the invention, a method of assembling a snack apparatus is provided. The method may include providing a sleeve of flexible material where a top end of the sleeve is unsealed and a bottom end of the sleeve is sealed and a chamber is formed in the sleeve, placing a food and drink in the chamber, and sealing the top end of the sleeve.

Other additional features and benefits will become apparent from the following drawings and descriptions of the invention. Other embodiments and aspects of the invention are described in detail herein and are considered a part of the claimed invention.

BRIEF DESCRIPTION OF THE DRAWINGS

The subject matter which is regarded as the invention is particularly pointed out and distinctly claimed in the claims at the end of the specification. The foregoing and other features and advantages of the invention are apparent from the following detailed description taken in conjunction with the accompanying drawings in which:

DETAILED DESCRIPTION FOR CARRYING OUT THE INVENTION

Figure 1:
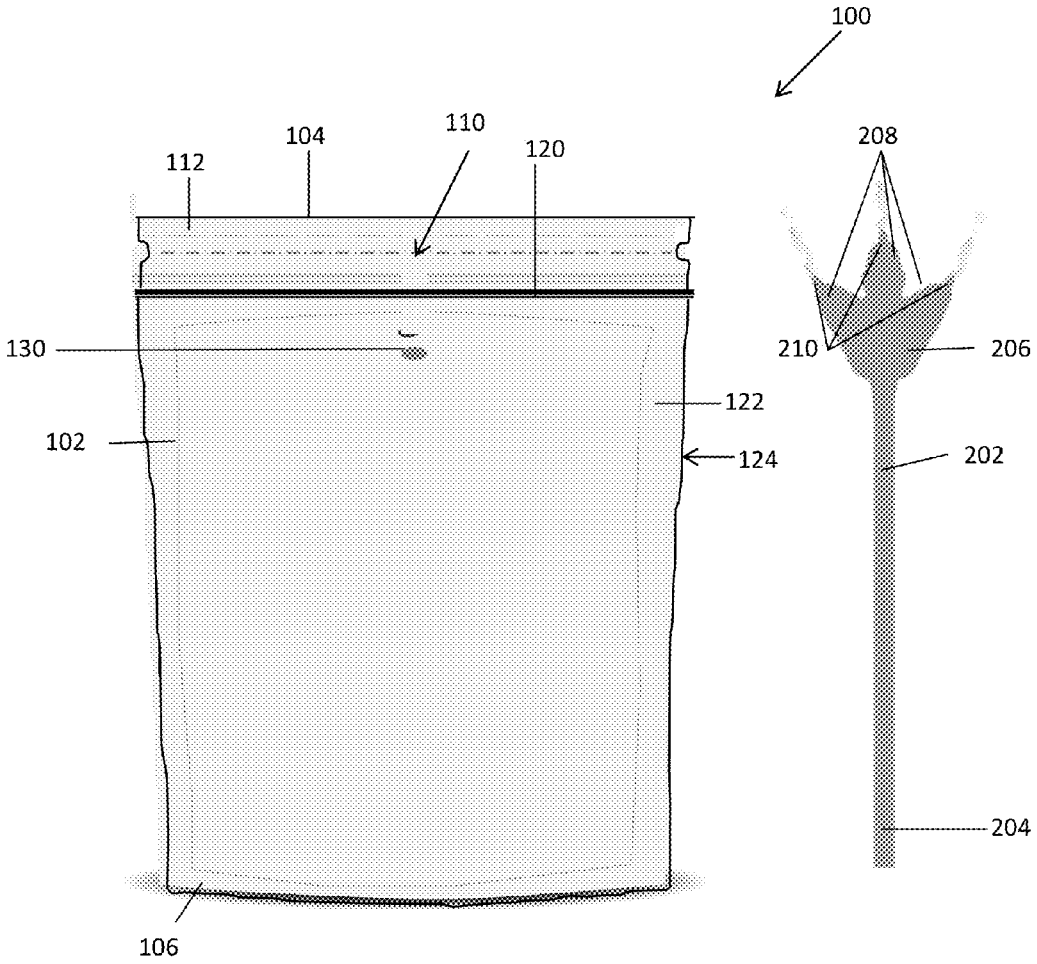
FIG. 1 is a front view of the apparatus to ease the consumption of drink and food, in accordance with an aspect of the invention.

For the purposes of promoting an understanding of the principles of the apparatus to ease the consumption of drink and food, reference will now be made to the embodiments, or examples, illustrated in the drawings and specific language will be used to describe these. It will nevertheless be understood that no limitation of the scope of the invention is thereby intended. Any alterations and further modifications in the described embodiments, and any further applications of the principles of the invention as described herein are contemplated as would normally occur to one skilled in the art to which the apparatus to ease the consumption of drink and food invention relates.

As used herein the terms "sleeve" and "pouch" are used interchangeably as they refer to the same type of device.

Referring to FIG. 1, an apparatus 100 to ease the consumption of drink and food generally includes a sleeve 102 and a straw 202. Sleeve 102 may be comprised of a flexible material known in the art to form drink pouches and may have a top end 104 and a bottom end 106. As shown, bottom end 106 may be permanently sealed. A chamber 108 (shown in FIG. 3) may be formed by sleeve 102. In various embodiments, apparatus 100 may contain drink and food in chamber 108. For example purposes, apparatus may include 100% real fruit or vegetable juice, such as grape, apple, orange, cranberry, carrot, and tomato and 100% real fruit or real fruit slices, (fresh or dried, for example,) such as grapes, apples, oranges, cranberries, carrots, and/or tomatoes. In other embodiments, other types of juice or juice cocktail and smaller pieces of fruit may be included in chamber 108. Furthermore, another enclosure within the chamber such as a pouch may be used to contain the fruit and isolate the fruit from the liquid or juice.

Still referring to FIG. 1, sleeve 102 is shown sealed at top end 104. A perforation 110 may be provided on top end 104. A portion 112 of sleeve 102 may be configured to be removed when a user tears along perforation 110 to form an opening 114 (shown in FIG. 3) with chamber 108. Also shown in FIG. 1 is a seal 120, which may be formed on first end 104, and may be formed generally inferior to perforation 110. Seal 120 may be configured to releasably attach a first side 122 of sleeve 102 to a second side 124 of sleeve 102. Sleeve 102 may also include a target 130 for the insertion of straw 202. The flexible material of sleeve 102 may be weakened or otherwise altered by any means known in the art so that sleeve 102 may be punctured with relative ease by straw 202.

Figure 4:
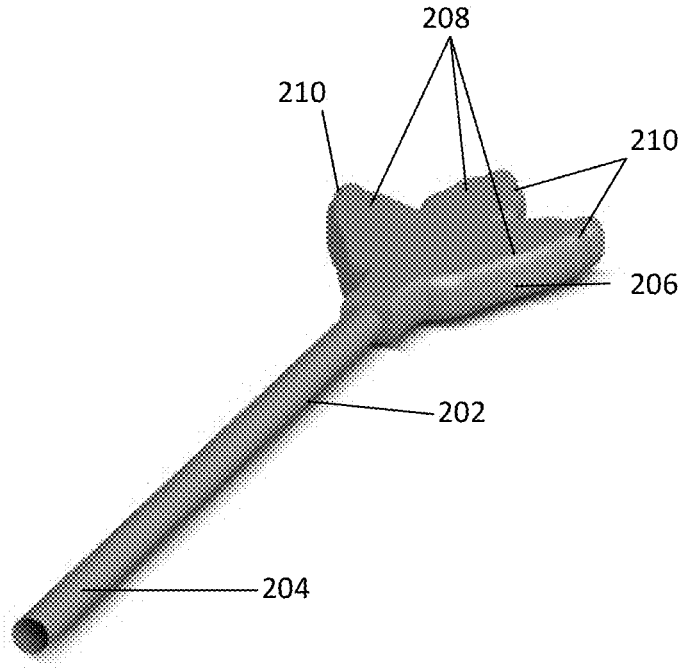
FIG. 4 is a perspective view of the straw of the apparatus of FIG. 1, in accordance with an aspect of the invention.

Referring to FIGS. 1 and 4, straw 202 may include a first end 204 and a second end 206. First end 204 may be configured to be inserted into the chamber through the sleeve 102 to allow consumption of the drink. First end 204 may be configured in any manner known in the art of drink pouches that allows for insertion of the straw into the sleeve 102. Second end 206 is comprised of at least one prong 208, the at least one prong 208 configured to be inserted into chamber 108 and into the food. In another alternative embodiment, second end 206 includes at least two prongs 208. In still another embodiment second end 206 includes three prongs 208. In the embodiments that include more than one prong 208, each of the prongs 208 may be used as a straw to remove drink in chamber 108. At least one cap 210 may be provided on each of the at least one prong 208 to prevent fluid from exiting the at least one prong. In at least one embodiment, at least one cap 210 may be configured to be removed such that each of the at least one prongs 208 may be used as a straw.

Figure 2:
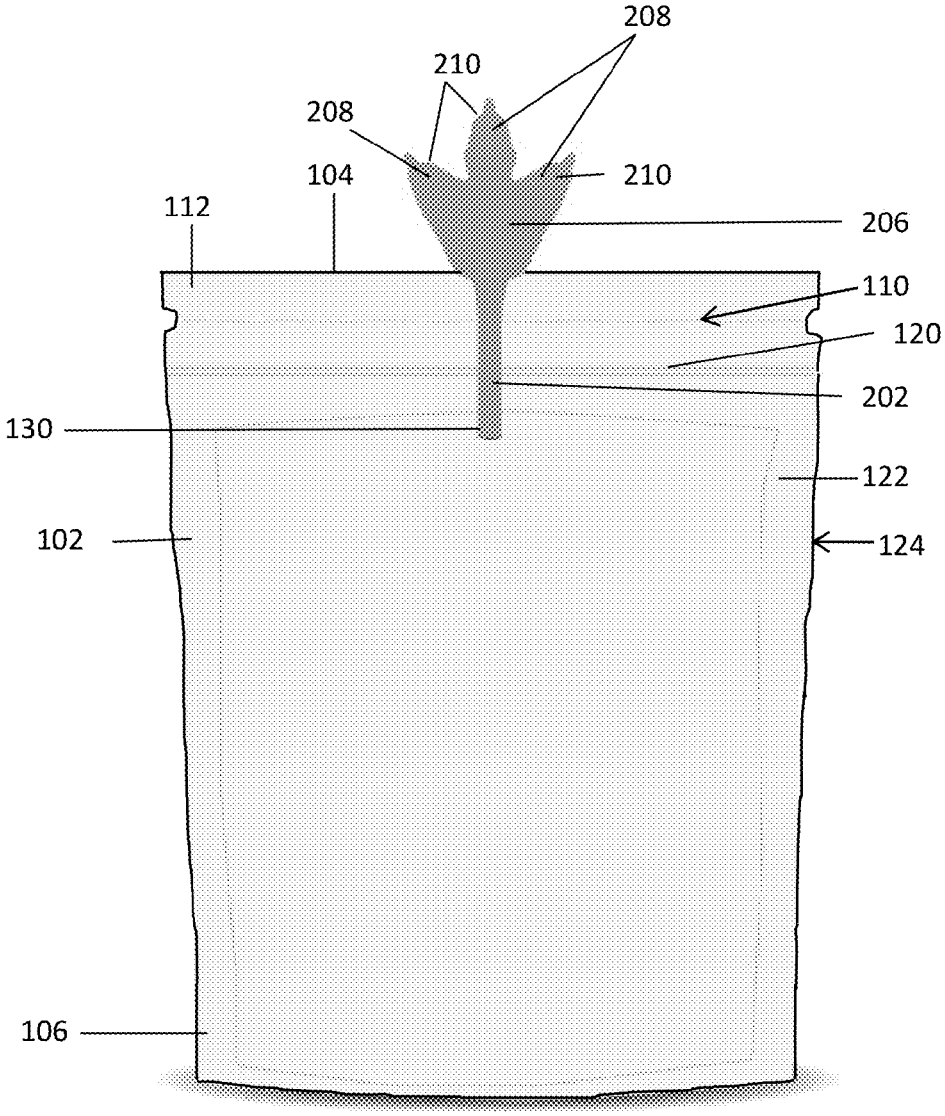
FIG. 2 is a front view of the apparatus of FIG. 1, where the straw has been inserted into the sleeve for consumption of drink, in accordance with an aspect of the invention.

Now referring to FIG. 2, straw 202 is shown inserted into sleeve 102 through target 130. Straw 202 may be inserted by placing pressure on the straw above target 130. The juice may then be removed from the chamber 108 through a sucking action on the second end of straw 202 or by placing pressure on sleeve 102.

Figure 3:
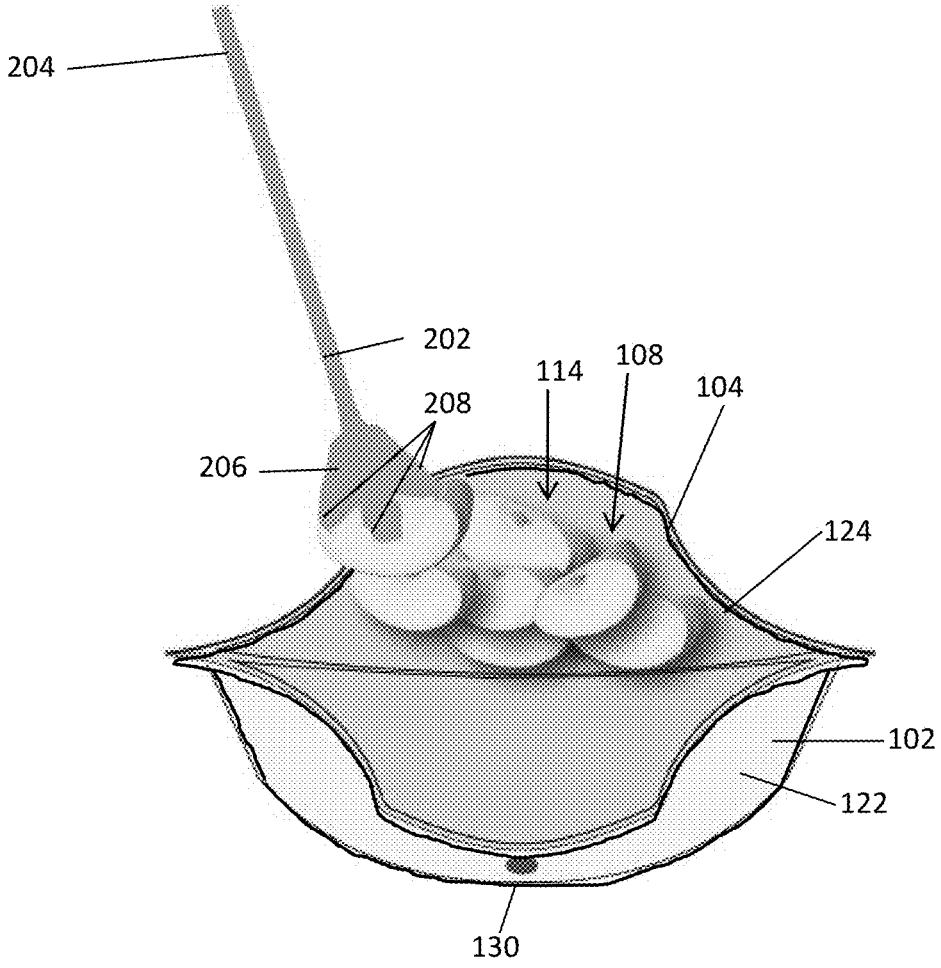
FIG. 3 is a top view of the apparatus of FIG. 1, where the first end of the sleeve has been opened and the straw has been inserted onto the sleeve for consumption of food, in accordance with an aspect of the invention.

Now referring to FIG. 3, sleeve portion 112 has been removed by tearing along perforation 110. In alternative embodiments, portion 112 may be removed by other means, such as, for example, cutting. The removal of portion 112 forms an opening 114 which allows access to chamber 108. Straw 202 may then be inserted into chamber 108, at least one prong 208 may be used to secure the food to straw 202, and straw 202 and the food may then be removed from chamber 108. These steps may be repeated as necessary to remove all of the food from chamber 108. Sleeve 102 and chamber 108 may be closed and opened by seal 120 if all of the food is not consumed in a single sitting. Seal 120 may be a press-fit seal, a zip seal or any other type of seal known in the art.

Figure 5:
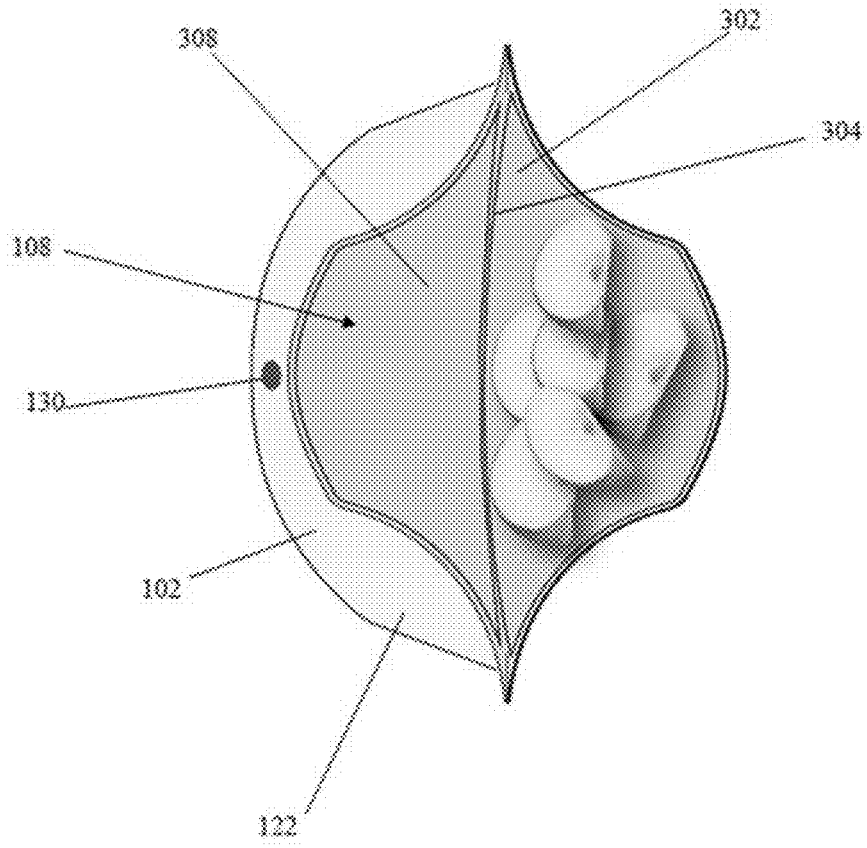
FIG. 5 is a top view of the apparatus to case the consumption of drink and food, in an aspect of the invention where the food is in a chamber isolated and separate from drink.

FIG. 5 depicts an embodiment of the apparatus in accordance with the invention, which is similar to the apparatus depicted in FIGS. 1-4, except as described below. Referring to FIG. 5, in one aspect of the invention, the container or sleeve 102 contains a first chamber 308 which receives a liquid such as a drink or fruit drink which may include a pure fruit juice, and a second chamber 302 which it utilized as a food chamber 302 to receive a food such as fruit pieces therein. The first chamber 308 containing the liquid such as a fruit juice is isolated from the second chamber 302 containing the food such as fruit slices therein. The first chamber 308 and second chamber 302 may be separated by a common wall 304 which may be integrated within the sleeve 102. In such an embodiment, a straw (such as the straw shown previously described herein) may be pierced through target 130 so that the drink or juice in first chamber 308 may be drank without disturbing the fruit located in second chamber 302. Thus, in such an embodiment, the chamber 108 is subdivided into subchambers, namely, a first chamber 308 and a second chamber 302. The first chamber may include a liquid such as a fruit juice, while the second chamber includes food such as fruit.

Although the invention has been described herein as including primarily fruit and juice, other foods may be used in accordance with the invention. For example, referring to FIG. 5, the first chamber 308 could include a drink such as milk and the second chamber 302 may include a food such as cookies, donuts or other confectionary-type products typically eaten together with milk. Other combinations of foods such as various types of beverages and snacks may also be used within the present invention.

The present invention also includes a method of consuming food and drink from a apparatus 100. The method may include the step of providing a sleeve 102 and a straw 202, as shown in FIG. 1. The apparatus 100 may include a sleeve 102 of flexible material with a sealed top end 104 and a sealed bottom end 106, forming a chamber 108, the chamber 108 formed by the sleeve 102 and configured to contain food and drink. The sleeve 102 may include a perforation 110 formed in the top end 104. The straw 202 provided may include a first end 204 configured to be inserted into the sleeve and through the flexible material, and a second end 206 including at least one prong 208 configured to be inserted into chamber 108 and the food. The method may also include the step of inserting the straw in to the chamber through the flexible material as shown in FIG. 2. The method may also include the steps of drinking the drink through the straw 202, removing the straw 202 from the sleeve 102, and tearing the perforation 110 to create an opening 114 in communication with chamber 108. A sleeve 102 torn along the perforation 110 resulting in an opening 114 in communication with chamber 108 is shown in FIG. 3. The method may also include the steps of inserting the second end 206 of the straw 202 into chamber 108 and into the food as well as removing the food from chamber 108 and eating the food, as shown in FIG. 3. In another embodiment of the method, a seal 120 shown in FIG. 1, may be provided on sleeve 102 and the steps of sealing and unsealing the sleeve 102 may be included. In still another embodiment, the steps of freezing and thawing the sleeve 102 and its contents may be included.

In another aspect, the invention includes a method of assembling a snack apparatus; the method may include the steps of providing a sleeve of flexible material where a top end of the sleeve is unsealed and the bottom end of the sleeve is sealed and a chamber is formed in the sleeve, placing a food and drink in the chamber, and sealing the first end of the sleeve.

While embodiments of the invention have been illustrated and described in detail in the disclosure, the disclosure is to be considered as illustrative and not restrictive in character. All changes and modifications that come within the spirit of the invention are to be considered within the scope of the disclosure.

The invention claimed is:

1. An apparatus to ease the consumption of drink and food, the apparatus comprising:

a sleeve of flexible material having a top end and a bottom end, the sleeve defining a chamber, the chamber containing both a drink and a food;

a perforation formed in the top end, a portion of the sleeve configured to be removed by tearing along the perforation to form an opening in communication with the chamber;

a straw comprising a first end and a second end, the first end configured to be inserted into the chamber through the sleeve of flexible material and allow consumption of the drink, the second end comprised of at least one prong, the at least one prong configured to be inserted into the chamber and into the food; and wherein the first end and the second end of the sleeve are sealed.

2. The apparatus of claim 1, further comprising:

a seal formed on the top end, the seal configured to releasably attach a first side of the sleeve to a second side of the sleeve.

3. The apparatus of claim 2, wherein the drink and food are mixed together in the same chamber.

4. The apparatus of claim 3 wherein the food and drink are isolated from one another in said chamber.

5. The apparatus of claim 3, wherein:

the straw comprises three prongs.

6. The apparatus of claim 1, wherein:

the apparatus is configured to be frozen.

7. The apparatus of claim 1, wherein:

the food comprises fruit pieces.

8. The apparatus of claim 7 wherein the fruit is contained within a chamber within the container isolated from said drink.

9. The apparatus of claim 8 wherein the fruit is contained within a first chamber which is separated from a second chamber containing drink.

10. The apparatus of claim 7 wherein the food is mixed within the chamber with the drink.

11. The apparatus of claim 1, wherein:

the drink is pure fruit juice.

* * * * *